US005313377A

United States Patent [19]

Kasboske

[11] Patent Number: 5,313,377

[45] Date of Patent: May 17, 1994

[54] LIGHTING UNIT

[76] Inventor: George C. Kasboske, 2820 N. Whipple, Chicago, Ill. 60618

[21] Appl. No.: 48,360

[22] Filed: Apr. 15, 1993

[51] Int. Cl.[5] ..... F21Y 33/00

[52] U.S. Cl. ..... 362/122; 362/123

[58] Field of Search ..... 362/122, 123, 183, 145

[56] References Cited

U.S. PATENT DOCUMENTS

| | | | |
|---|---|---|---|
| 1,677,972 | 7/1928 | Marks | 362/123 |
| 2,188,528 | 1/1940 | Corina | 362/123 |
| 2,760,052 | 8/1956 | Owen | 362/123 |
| 2,853,822 | 9/1958 | Blackmon, Sr. | 362/123 |
| 5,063,485 | 11/1991 | Harris | 362/122 |
| 5,149,188 | 9/1992 | Robbins | 362/183 |

FOREIGN PATENT DOCUMENTS

| | | | |
|---|---|---|---|
| 500455 | 3/1954 | Canada | 362/123 |
| 8262 | 3/1898 | United Kingdom | 362/122 |
| 573350 | 11/1945 | United Kingdom | 362/123 |

*Primary Examiner*—Richard R. Cole

*Attorney, Agent, or Firm*—Wood, Phillips, VanSanten, Hoffman & Ertel

[57] ABSTRACT

A lighting unit having a source of illumination on a support with there being simulated vegetation on the support. The support includes a base that simulates a natural stem for the vegetation.

19 Claims, 2 Drawing Sheets

LIGHTING UNIT

BACKGROUND OF THE INVENTION

1. Field of the Invention

This invention relates to decorative lighting and, more particularly, to a lighting unit that blends into natural outdoor landscaping while at the same time performing a desired lighting function.

2. Background Art

Landscape lighting is commonly used in both commercial and residential environments. It is common to use ground lighting to border walks and driveways, and to accent buildings, trees, yard ornamentation, etc.

Typically, a low voltage light is used for this purpose. The illumination source is typically an area light which projects through 360° or may be focused in a much narrower range as to be directed at an object to be illuminated. These structures commonly employ a vertically extending stake atop which the illumination source is mounted. The stake is pressed into the ground in the vicinity of where the light is desired.

It is also known to couple the lights in series and to run a group of such lights off a single timer or a light sensitive switch. While of late solar powering is utilized, more commonly, the lights are interconnected by an electrical line which is fed from a conventional power supply. A transformer is provided between the supply and the lights.

One problem with this ground lighting is that the lights tend to stand out and commonly detract from the appearance of the landscaping into which they are incorporated. The user generally has few options as to what type of light will be employed. Aside from the fact that the lights themselves may not be attractive or fit into a landscaping scheme, the power supply lines further compromise aesthetics. While the lines may be buried under some circumstances to be out of sight, in other places this is not possible, as when the lights are installed on grounds that are covered with concrete, asphalt, brick, etc.

SUMMARY OF THE INVENTION

According to the invention, a lighting unit is provided having a source of illumination on a support, with there being simulated vegetation on the support. The support includes a base that simulates a natural stem for the vegetation.

With the above structure, the lighting unit serves the dual purpose of a) producing the appearance of natural vegetation to blend into landscaping and b) providing illumination.

The vegetation can be customized, as to match a landscaping scheme. The illumination source can be selected depending upon the desired effect. For example, the illumination source may be an area light that is intense enough to light up a path or other area, or merely an accent light. In the former case, the illumination source can be configured to project light through approximately 360° around the base or, alternatively, could be a flood light or spot light.

In one form, a lens is connected to the base so that light from the illumination source projects through the lens. The lens may be mounted between spaced ends of the base and may be mounted so as to interrupt the base between its ends.

The inventive structure lends itself to creating a wide range of different looks. For example, the vegetation may be one of a flower, a bush, and a tree. The base may simulate a stem/tree trunk.

In one form, a line is provided to deliver power from a supply to the illumination source. The line can be camouflaged in those environments in which the line cannot be readily hidden, as by being buried. One example of camouflage is to place leaves, or the like, on the line to give it the appearance of a live vine.

Further, according to the invention, a lighting unit is provided having an illumination source on a support, and structure on the support that is at least one of simulated vegetation and natural vegetation. The illumination source is an area light.

Solar energy receiving storage structure can be provided for connection to the illumination source to power the illumination source naturally.

In one form, the support for the illumination source is a vertically extending member with a central axis and the illumination source projects light from a point approximately at the central axis of the support.

DETAILED DESCRIPTION OF THE DRAWINGS

Figure 1:
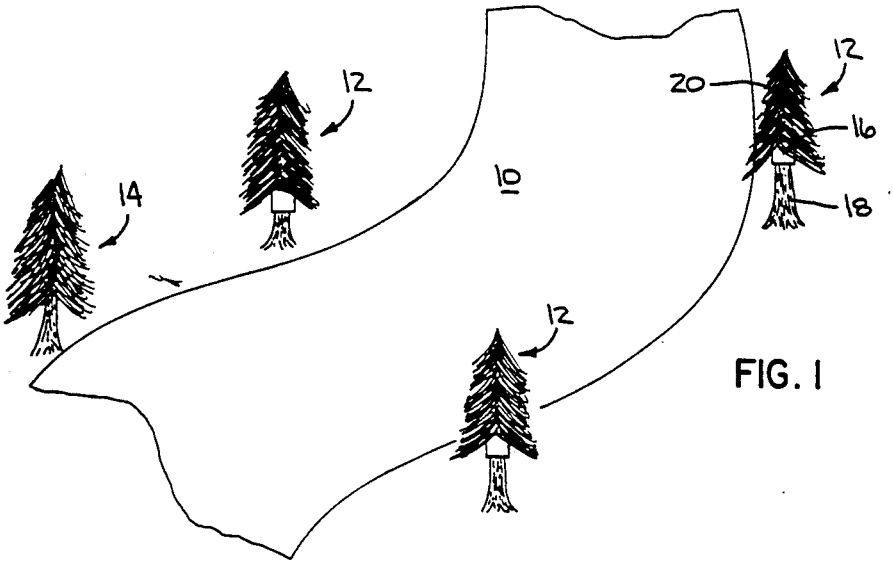
FIG. 1 is a schematic representation of a walkway having a plurality of lighting units with vegetation thereon according to the present invention.

In FIG. 1, a pathway 10 is shown as one exemplary environment for the present invention. The pathway 10 has at its sides a plurality of lighting units 12, according to the invention, which define a border along the pathway 10 and additionally contribute to the appearance of the area by simulating vegetation which can be combined with conventional vegetation at 14.

The lighting unit 12 in FIG. 1 consists of an illumination source at 16, held in an elevated position by a support/base 18. Vegetation 20, in this case, in the form of a bush, is provided over the illumination source 16 to give the appearance that the illumination source 16 is an integral part of the vegetation/bush 20. The pleasing aesthetics of the vegetation/bush 20 are realized with the added benefit of light from the illumination source 16. In this case, the vegetation/bush 20 is coordinated to match natural vegetation 14 in the vicinity thereof. The vegetation/bush 20 is preferably simulated vegetation, but could be replaceable natural vegetation.

Figure 3:
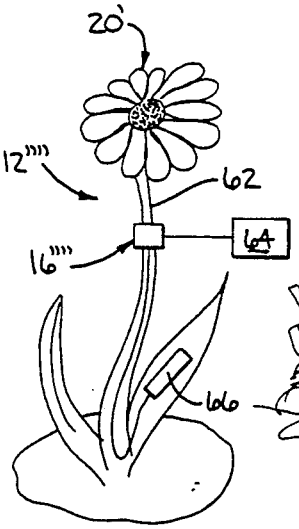
FIG. 3 is perspective view of one of the inventive lighting units in the form of a flower.
Figure 4:
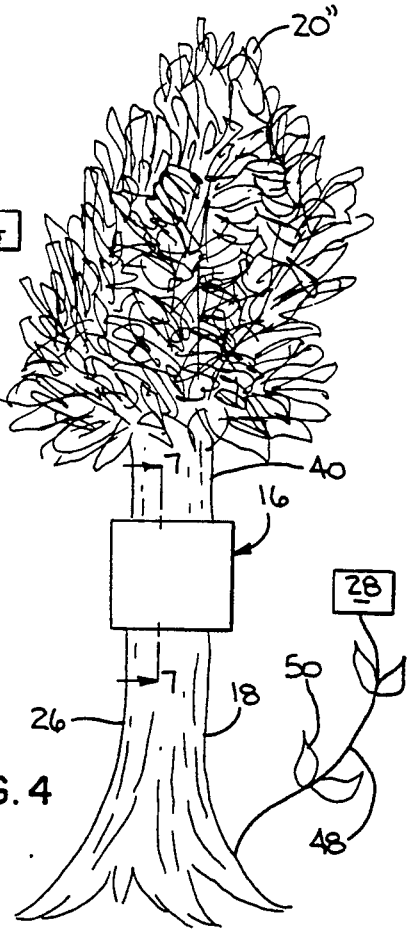
FIG. 4 is a perspective view of one of the inventive lighting units in the form of a tree.

There are virtually limitless styles of vegetation that can be used according to the invention. For example, in FIG. 3, the vegetation 20' is a flower, while in FIG. 4, the vegetation 20'' is a tree, and in FIG. 5, the vegetation 20''' is an exotic bush.

Figure 7:
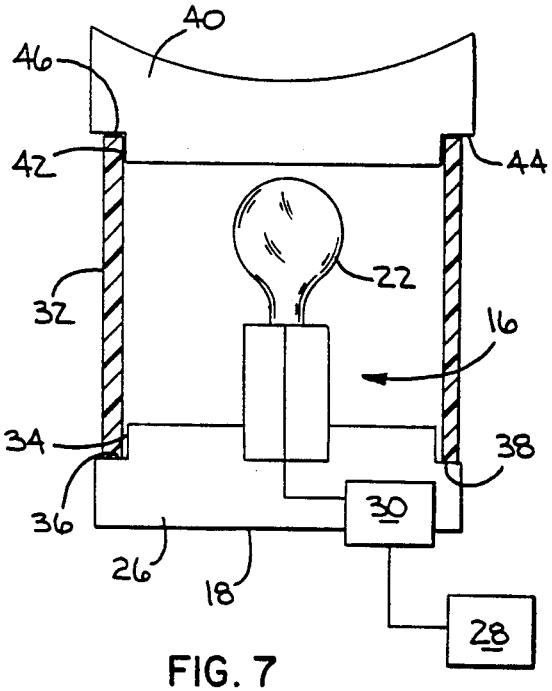
FIG. 7 is a cross-sectional view of a lens and illumination source taken along line 7—7 of FIG. 4.

The illumination source 16, as used in the lighting units in each of FIGS. 2–5, may be of a type as shown in detail in FIG. 7. Other types of illumination sources could of course be used. The illumination source 16 has a bulb 22 received within a socket 24 that is mounted to a bottom section 26 of the base 18. The bulb 22 is supplied from a conventional power source 28 through a transformer 30, with both the power source 28 and transformer 30 shown schematically in FIG. 7.

The bulb 22 projects light through a translucent lens 32, which may be clear, frosted, or colored as appropriate. The lens 32 may be made from glass, or as shown, a plastic material. The illumination source 16, mounted as shown in FIG. 7, produces area lighting which projects outwardly through a full 360°.

In the embodiment shown in FIG. 7, the lens 32 interrupts the base 18 and serves as an integral part of the construction of the lighting unit 12. That is, the bottom base part 26 has an undercut surface 34 defining an annular shoulder 36 upon which the bottom edge 38 of the lens 32 bears. A top section 40 of the base 18 has a radial undercut surface 42 defining an annular shoulder 44 which nests in the lens 32 and rests upon the upper edge 46 of the lens 32.

This stacked arrangement of parts facilitates assembly and disassembly as to change the bulb 22. This arrangement also allows interchangeability of the top section 40 to vary the nature of the vegetation 20.

To further give the lighting unit 12 a natural effect, a line 48, which provides power to the illumination source 16 from the power source 28, can be camouflaged as by being colored and/or by the addition of leaves 50 to simulate a live vine. This is a desirable feature in environments in which the surface upon which the lighting units 12 cannot be penetrated for purposes of burying the line 48.

Figure 6:
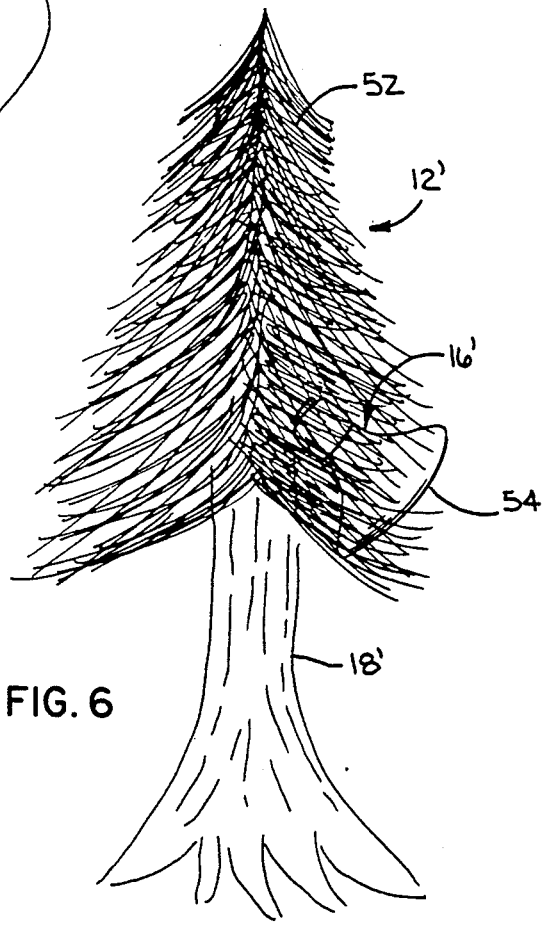
FIG. 6 is a side elevation view of one of the inventive lighting units in the form of a tree with a spot/flood light thereon.

FIG. 6 shows a modified form of lighting unit 12' including a base 18' with foliage 52 thereon, as to simulate a pine tree. In this case, an illumination source 16' is in the form of a spot or flood lamp 54 to provide intense focused light as is desirable for lighting a pathway, or the like. The same aesthetic appeal is realized i.e. it appears that light is projecting from natural vegetation.

Figure 2:
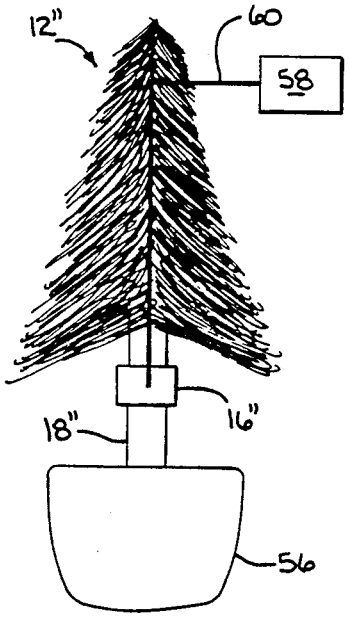
FIG. 2 is a side elevation view of one of the inventive lighting units in the form of a potted bush.

In FIG. 2, a lighting unit 12'' is shown to include a base 18'' having an illumination source 16'' between the ends of the base 18'' with the base 18'' firmly embedded in a planter 56 to give the appearance of a potted bush.

The lighting unit 12'' has a collector 58 for solar energy which is supplied through a line 60 to the illumination source 16''.

Figure 5:
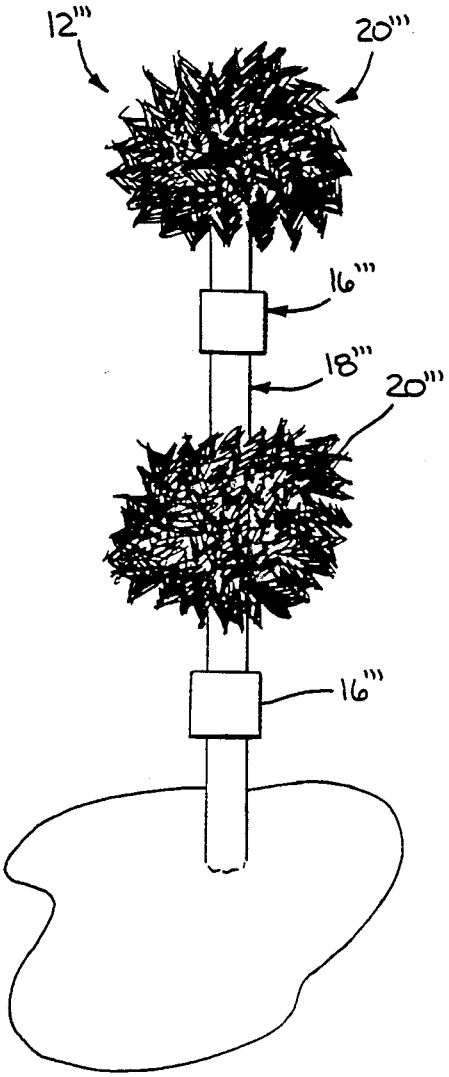
FIG. 5 is a perspective view of one of the inventive lighting units in the form of a shrub.

In FIG. 5, a lighting unit 12''' is shown with vertically spaced vegetation 20''' on a base 18''' so as to simulate an exotic shrub. In this case, two vertically spaced illumination sources 16''' are provided to enhance illumination.

A further modified form of lighting unit, according to the present invention, is shown at 12'''', in the form of a flower having a stem 62 with an illumination source 16'''' incorporated therein and powered from either an external supply 64 or energy from a solar collector 66.

It can be seen that virtually an infinite number of different styles of natural and artificial vegetation can be produced and combined with lighting to give a unique visual effect. The inventive structure is aesthetically pleasing yet at the same time fully functional.

The foregoing disclosure of specific embodiments is intended to be illustrative of the broad concepts comprehended by the invention.

I claim:

1. A lighting unit comprising:

a source of illumination;

a support for said illumination source;

means for connecting the illumination source to the support; and means on the support for simulating vegetation, said support including a base simulating a natural stem for the simulated vegetation, said base having a peripheral surface bounding a space, said source of illumination residing at least partially within the space bounded by the peripheral surface so that light from the illumination source projects from within the space bounded by the peripheral surface to externally of the base, whereby the lighting unit serves the dual purpose of a) producing the appearance of natural vegetation and b) providing illumination.

2. The lighting unit according to claim 1 wherein the illumination source comprises an area light.

3. The lighting unit according to claim 1 wherein the illumination source comprises at least one of a flood light and a spot light.

4. The lighting unit according to claim 1 wherein the illumination source comprises a means for projecting light through approximately 360° around the base.

5. The lighting unit according to claim 4 wherein the vegetation simulating means is located so that the light projecting around the base is unobstructed by the vegetation simulating means through a substantial distance around the periphery of the support.

6. The lighting unit according to claim 1 further including a lens and means for mounting the lens to the base, said connecting means connecting the illumination source to the support so that light from the illumination source projects through the lens.

7. The lighting unit according to claim 6 wherein the base has spaced ends and the mounting means mounts the lens to the base between the ends thereof.

8. The lighting unit according to claim 1 wherein the vegetation simulating means and base together produce the appearance of at least one of a) a flower, b) a bush, and c) a tree.

9. The lighting unit according to claim 1 wherein the base has spaced ends and the base is interrupted between the ends thereof around the entire peripheral surface to accommodate the illumination source.

10. The lighting unit according to claim 1 including a line for delivering power from a supply to the illumination source, there being means on the line for camouflaging the line.

11. The lighting unit according to claim 10 wherein there is a portion of the line that extends away from the support and said camouflaging means comprises means for causing the portion of said line to appear like a live vine.

12. A lighting unit comprising:

a source of illumination;

a support for said illumination source having a peripheral surface and spaced ends and comprises a vertically extending member with a central axis;

means for connecting the illumination source to the support so that light projects from said illumination source through approximately a full 360 around the peripheral surface of the support from a point approximately at the central axis of the support between the spaced ends of the support; and means on the support that is at least one of a) simulated vegetation and b) natural vegetation, wherein the illumination source is an area light.

13. The lighting unit according to claim 12 wherein the illumination source is at least one of a flood light and a spot light.

14. The lighting unit according to claim 12 wherein the means on the support is at least part of at least one of a) a tree, b) a bush, and c) a flower.

15. The lighting unit according to claim 12 including solar energy receiving means and means for connecting the energy receiving means to the illumination source so as to supply energy from the energy receiving means to the illumination source.

16. The lighting unit according to claim 12 wherein the support is interrupted where the illumination source resides.

17. The lighting unit according to claim 12 including a line for delivering power from a supply to the illumination source, there being means on the line for camouflaging the line.

18. The lighting unit according to claim 17 wherein there is a portion of the line extending away from the support and said camouflaging means comprises means for causing the portion of said line to appear like a live vine.

19. The lighting unit according to claim 12 wherein the support has spaced ends a generally cylindrical configuration with a first axis and there is a lens having a generally cylindrical configuration with a second axis, the first and second axes are substantially parallel, and light from the illumination source projects through the lens from a location between the ends of the support.

* * * * *